US010343866B2

(12) United States Patent
Giurlani et al.

(10) Patent No.: US 10,343,866 B2
(45) Date of Patent: Jul. 9, 2019

(54) DRAGGING ELEMENT FOR DRAGGING WEB MATERIALS

(71) Applicant: FUTURA S.P.A., Capannori Fraz. Guamo (IT)

(72) Inventors: Giovacchino Giurlani, Segromigno in Monte-fraz. Capannori (IT); Roberto Gaspari, San Ginese di Compito-fraz. Capannori (IT)

(73) Assignee: FUTURA S.P.A., Capannori (LU) Fraz. Guamo (IT)

( * ) Notice: Subject to any disclaimer, the term of this patent is extended or adjusted under 35 U.S.C. 154(b) by 0 days.

(21) Appl. No.: 14/435,555

(22) PCT Filed: Sep. 19, 2013

(86) PCT No.: PCT/IT2013/000251
§ 371 (c)(1),
(2) Date: Apr. 14, 2015

(87) PCT Pub. No.: WO2014/061043
PCT Pub. Date: Apr. 24, 2014

(65) Prior Publication Data

US 2015/0259169 A1 Sep. 17, 2015

(30) Foreign Application Priority Data

Oct. 17, 2012 (IT) ..... FI2012A0213

(51) Int. Cl.
*B65H 20/16* (2006.01)
*B41F 13/03* (2006.01)

(52) U.S. Cl.
CPC ..... *B65H 20/16* (2013.01); *B41F 13/03* (2013.01); *B65H 2301/522* (2013.01); *B65H 2404/221* (2013.01); *B65H 2701/1311* (2013.01); *B65H 2701/1924* (2013.01)

(58) Field of Classification Search
CPC ..... B65H 57/003; B65H 2301/522; B65H 19/102; B65H 20/16; B65H 2404/55; B65H 2404/551; B65H 2404/5511; B41F 13/03
USPC ..... 226/91, 92
See application file for complete search history.

(56) References Cited

U.S. PATENT DOCUMENTS

| | | | | |
|---|---|---|---|---|
| 4,491,503 A | | 1/1985 | Adams et al. | |
| 4,910,359 A | * | 3/1990 | Dougherty | H01B 7/0823 174/110 V |
| 5,400,940 A | | 3/1995 | Sato et al. | |
| 5,412,447 A | | 5/1995 | Earle | |
| 5,959,059 A | * | 9/1999 | Vedula | C08G 18/4854 152/151 |

* cited by examiner

*Primary Examiner* — Michael C McCullough
(74) *Attorney, Agent, or Firm* — McGlew and Tuttle, P.C.

(57) ABSTRACT

Dragging element for dragging web materials comprising at least a portion with at least one through cut (2) apt to engage a part (40) of a web material (4) intended to be moved in a direction imposed by the same dragging element that follows a predetermined operating path, said at least one cut (2) is helicoidal.

20 Claims, 6 Drawing Sheets

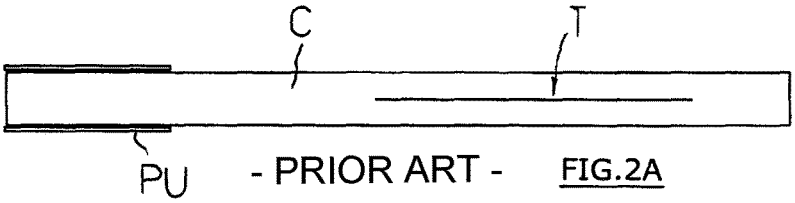
- PRIOR ART - FIG.2A
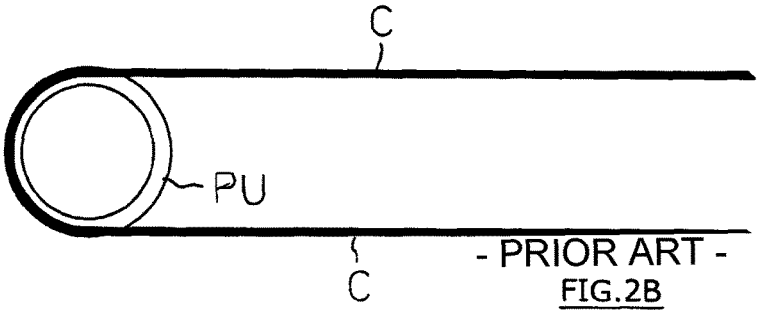
- PRIOR ART - FIG.2B
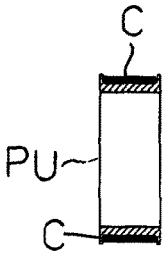
- PRIOR ART - FIG.2C
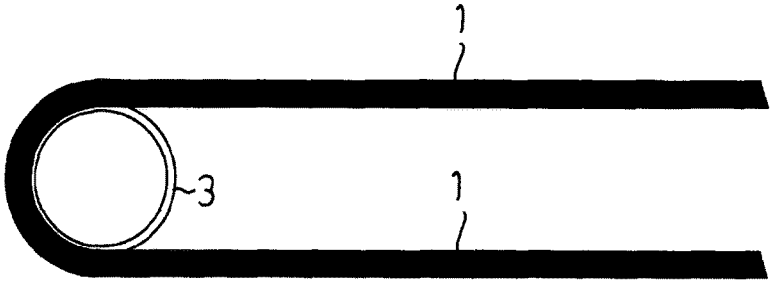
FIG.7
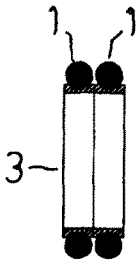
FIG.6
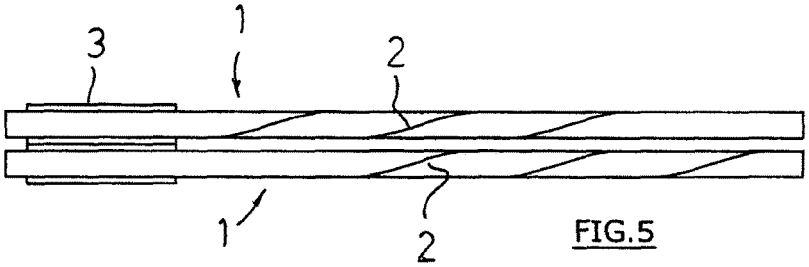
FIG.5

DRAGGING ELEMENT FOR DRAGGING WEB MATERIALS

The present invention relates to a dragging element for dragging web materials.

It is known that, in certain industrial operations, a weblike material must be properly guided along a path crossing a plurality of operative stations in each o which the same material is subject to a specific step process. For example, with reference to FIG. 1, showing a plurality of operative stations of a paper converting plant, the weblike material is made by two paper plies (V1, V2) that are unwound from respective reels positioned on two different unwinders (U1, U2) and that, after having crossed a printing unit (P) which prints drawings or decorative motifs on a side of each of them, enter an embosser (E) and subsequently feed a winding unit (R) where paper rolls or "logs" are formed by winding the two plies on cardboard tubular cores. Said logs are destined to be transversely cut to obtain shorter rolls that can be used, for example, as toilet paper or kitchen paper.

Possibly, depending on the tension applied to the paper plies and their quality, the paper plies may be subject to breaking. In that case, it necessary to convey the broken edge of the paper ply up to the operative station concerned (to the winding unit R or the embosser E or the printing unit P in the above-mentioned example); to this end, use is made of dragging belts, commonly said "paper passing belts", that are flat belts having a rectangular cross section and are provided, at regular intervals, with a longitudinal central through cut in which an edge of the broken ply to be moved can be inserted. Consequently, the paper ply is hooked to the belt that, therefore, can drag it up to the desired operative station. FIGS. 2A, 2B and 2C show, respectively, a plan top view, a side view and a front view of a dragging belt of the above-mentioned type, wherein the belt is denoted by the reference "C" and the respective longitudinal cut is denoted by the reference "T", while the reference "PU" denotes a pulley for guiding the belt.

Said belts are developed along paths whose length can be of several tens of meters, which implies technical drawbacks due both to the need of providing a proper supporting and guiding system for the belts and to the need of providing a proper tensioning of the same belts.

Therefore, these belts are driven by pulleys appropriately positioned at predetermined points of the path imposed by the specific structure of the plant concerned. These pulleys, having to ensure a correct support of the belts, have substantially the same width of the latter.

Consequently, taking into account that generally in a paper converting plant two or more plies of paper are simultaneously processed, the guide system of the belts requires relatively large dimensions, in contrast with the current needs of a greater compactness of the mechanisms serving the plants. Moreover, given the tension required for driving the paper plies, the latter can easily tear in the vicinity of their part inserted in the longitudinal cut of the belts or escape from the belts themselves.

The main purpose of the present invention is to eliminate, or at least greatly reduce, the aforementioned drawbacks.

This result is achieved, according to the present invention, by adopting the idea of making a paper dragging belt having the features disclosed in claim 1. Other features of the present invention are the subject of the dependent claims.

Thanks to the present invention, it is possible to ensure a correct dragging of paper plies by reducing the risk of rupture of the same in the dragging phase and at the same time reducing the overall dimensions of the means for dragging the plies. Furthermore, a dragging element in accordance with the present invention involves no additional cost compared to traditional paper dragging belts.

These and other advantages and features of the present invention will be best understood by anyone skilled in the art thanks to the following description and to the attached drawings, given by way of example but not to be considered in a limiting sense, in which:

FIG. 1 schematically shows a paper converting plant;

FIGS. 2A-2C show a conventional paper dragging belt;

FIGS. 3 and 4 respectively show a side view and a perspective view of a paper dragging belt made with a dragging element according to a possible embodiment of the present invention;

FIGS. 5, 6 and 7 show two paper dragging belts, each of each is made as shown in FIGS. 3 and 4, seen in top plan view (FIG. 5), in vertical section view (FIG. 6) and in side view (FIG. 7);

Figure 3:
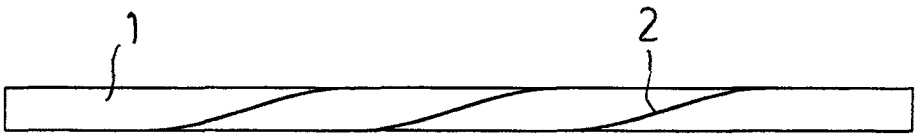
Figure 4:
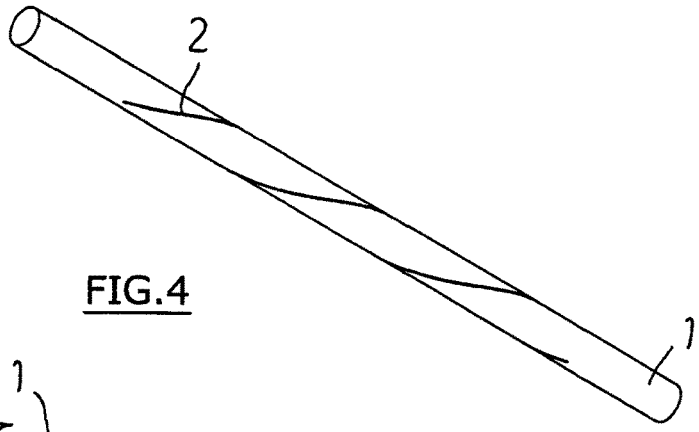
Figure 9:
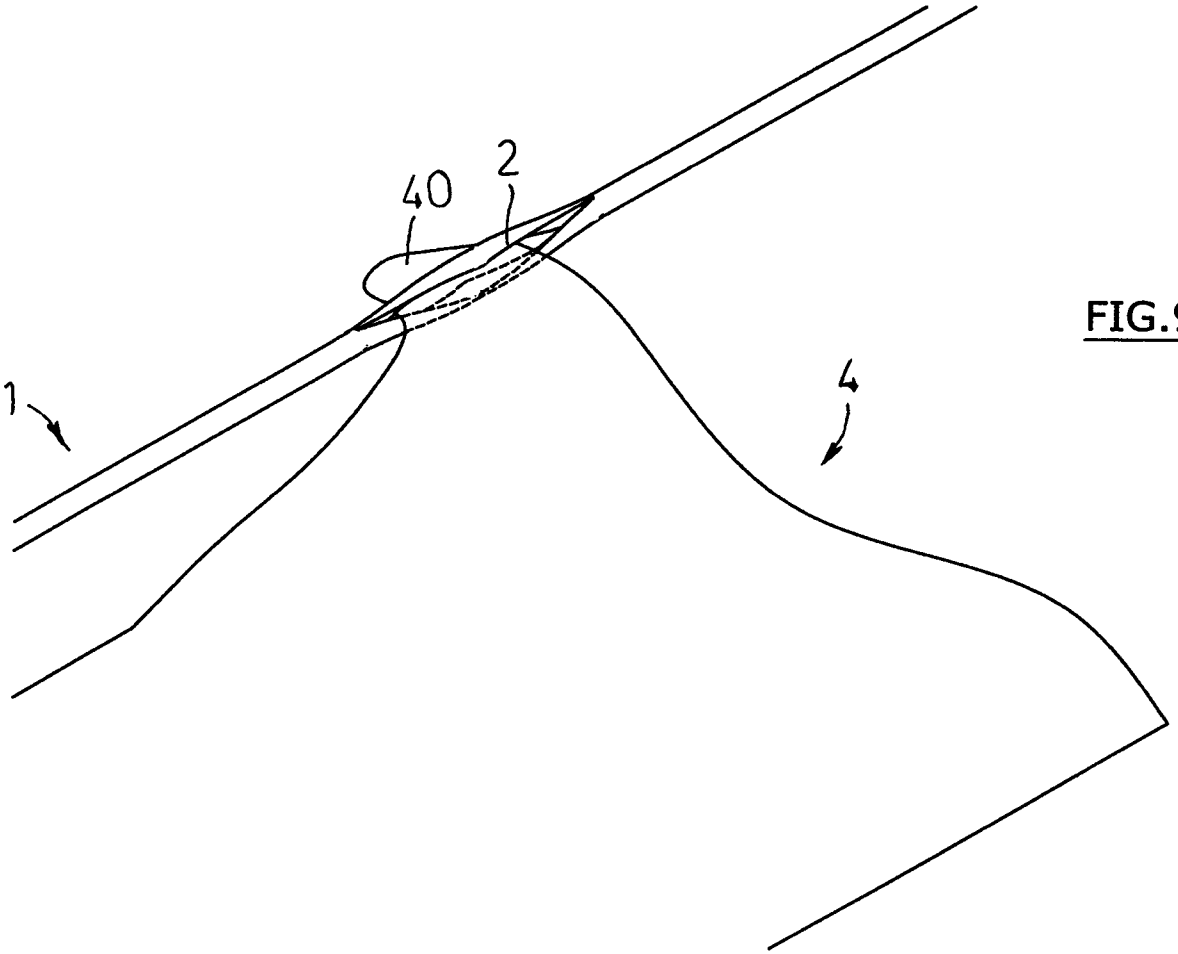
Figure 10:
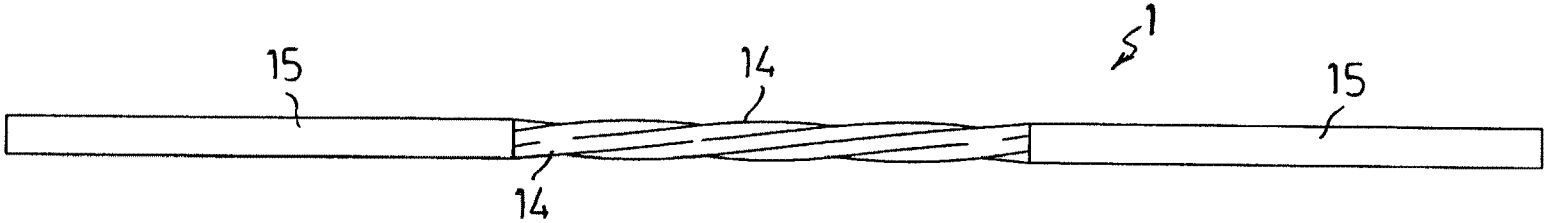
Figure 11:
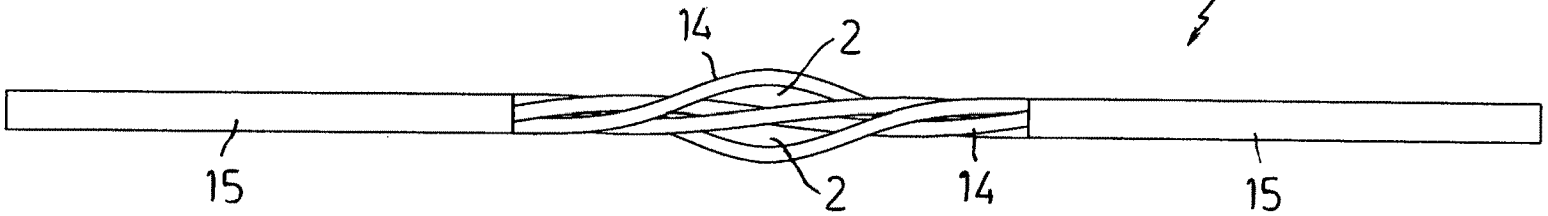
Figure 12:
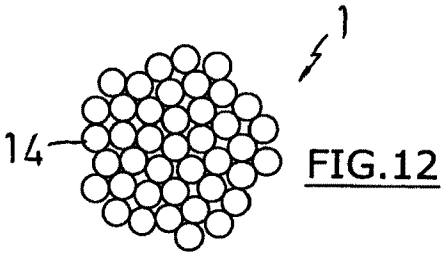
Figure 15:
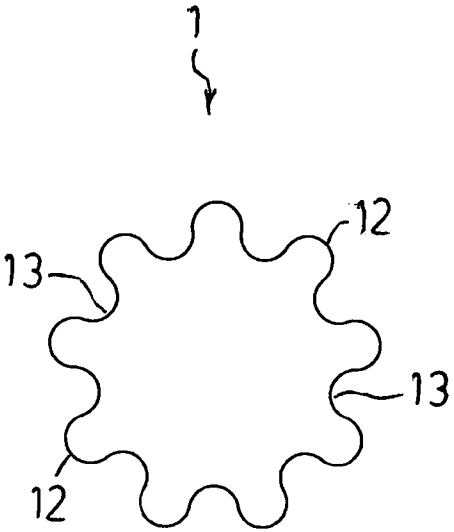
Figure 14:
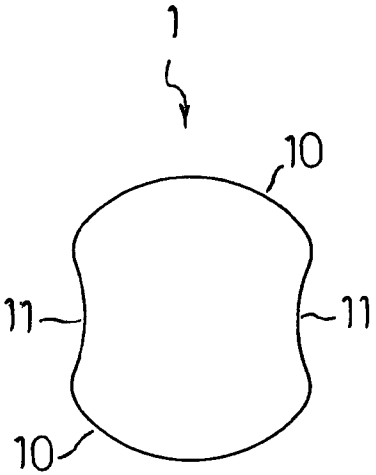
Figure 13:
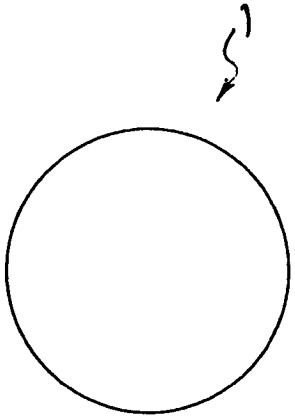

FIG. 9 schematically shows the hooking of an edge of a paper ply to a dragging belt made as shown in FIGS. 3 and 4;

FIGS. 10, 11 and 12 show a further embodiment of a dragging element according to the present invention;

FIGS. 13, 14 and 15 show three possible cross section shapes of the dragging element shown in FIGS. 3-9.

Figure 1:
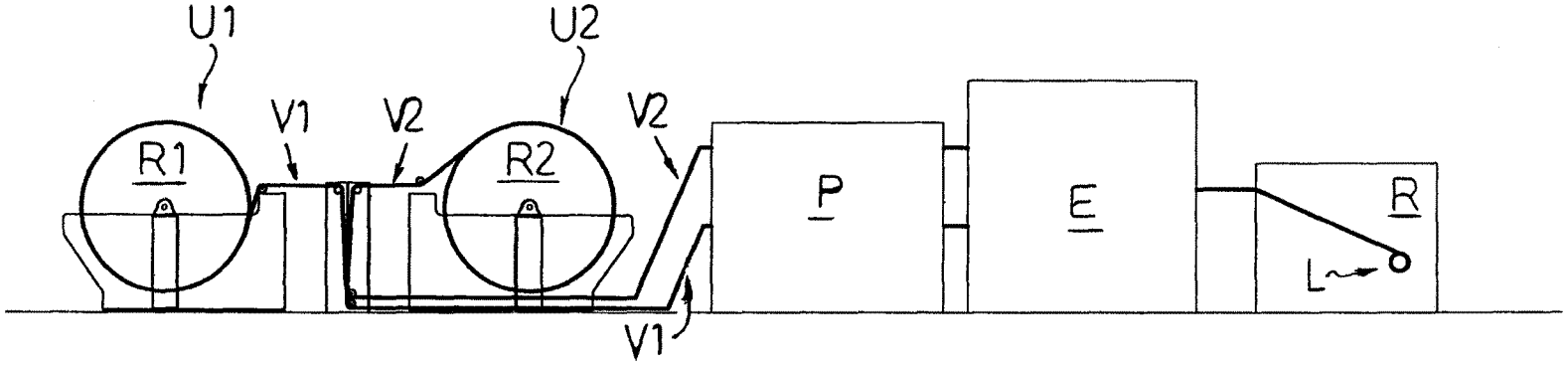

Reduced to its basic structure and with reference to FIGS. 1-9, a paper dragging belt (1) according to the present invention is made by an element having a prevailing longitudinal development (i.e. an element having a dimension prevailing on the other two) comprising a portion with a through cut (2) in which an edge or flap (40) of a paper ply (4) can be hooked, said paper web being destined to be moved along a direction imposed by the same belt that follows a predetermined operative path along several machines (for example, the machines of a paper converting plant like that disclosed above with reference to FIG. 1).

Advantageously, said cut (2) is helicoidal and said belt (1) has a circular cross section, preferably solid.

Preferably, the cut (2) is repeated at regular intervals along the belt (1) that, therefore, may generally have a plurality of helicoidal cuts (2) spaced from each other at predetermined intervals.

For example, the belt may be mad of a thermoplastic polyurethane, i.e. of the type sold by Habasit AG with the trademark "Polycord".

Figure 8:
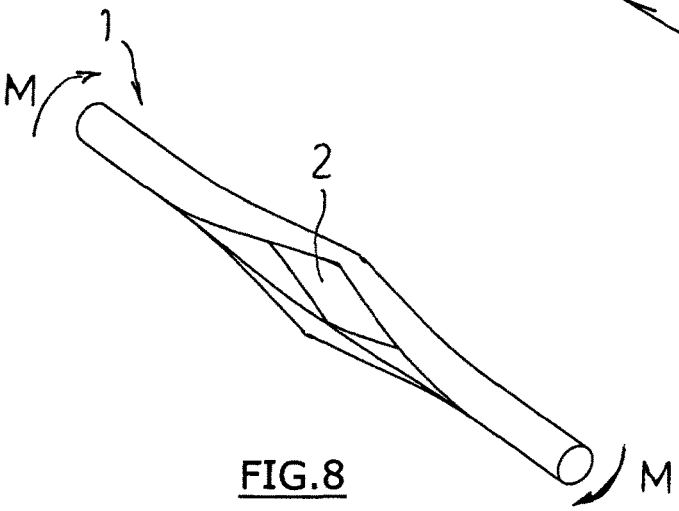
FIG. 8 shows a paper dragging belt made as shown in FIGS. 3 and 4, with the cut open to receive an edge of a paper ply to be hooked to the same belt.

In order to open the cut (2) and to insert in it the edge or flap (40) of the paper ply (4) that must be attached to the belt (1), the operator simply has to hold the two parts of the belt (1) in the vicinity of the right side and the left side of the cut (2) and rotate them in opposite directions as schematically indicated by arrows "M" in FIG. 8. In this way, the cut (2) opens and creates a space that is sufficient to insert the flap (40) of the ply (4). By releasing the said parts of the belt (1), the flap (40) of the web (4) will be locked inside the cut (2) which will close spontaneously given the elasticity of the material of which the belt (1) is made.

Since the flap (40) of the ply (4) hooked to the belt (1), that is, locked inside the cut (2), assumes a helical conformation corresponding to that of the cut (2), its engagement is more effective than making use of the traditional systems.

Furthermore, the cross section of the belt is reduced, so that on the same guide pulley (3) can be placed two belts (1) instead of one, as shown in FIG. 5 and FIG. 6. Comparing FIG. 6 with FIG. 2C, one can observe that, for equal overall dimensions of the guide pulley and support (3; PU), the same space is occupied by two belts (1) in accordance with the present invention rather than by a single traditional belt (C).

The belt (1) can be arranged along the operative paths normally followed by the traditional paper dragging belts and therefore, for example, with reference to a plant like that shown in FIG. 1, it can follow a path along the unwinding and the winding units as well as a path between the unwinding and the embossing unit or a path between the embossing and the winding units.

The cross section of the belt (1) can be circular (as in FIG. 3) or even different. For example, the belt (1) can exhibit a biconvex shape, as shown in FIG. 4, that is, with two opposed convex sides (10) joined by two concave sides (11). Otherwise, the belt (1) can exhibit a star-shaped cross section as shown in FIG. 5, with a series of reliefs (12) spaced by corresponding depressions (11). In all these example the cross section of the belt (1) is solid.

Alternatively, the dragging element (1) can also be realized as a rope consisting of several twisted strands (14) covered by a sheath (15) except that in predefined areas where the strands (14) are exposed and where, by means of a torsion exerted as described with reference to the previous example, it is produced the opening of the cut (2) due to the spacing of the strands themselves as a result of the torsion. In this example, the dragging element (1) has a plurality of helical through cuts (2) each of which can be used for locking an edge or flap the paper ply to drag. The cuts (2) are formed by the same strands (14), that is, they correspond to the spaces existing between the strands. In FIG. 2 it is shown a cross-sectional view of the dragging element shown in FIG. 10, that is, in the configuration assumed with the cuts (2) not accessible.

It is understood that a dragging element in accordance with the present invention can be used in all cases in which it is necessary to convey a weblike material along a predetermined operating path upon engagement of the material to the belt.

In practice, the details of execution may vary in any equivalent way as in the shape, size, nature, type and arrangement of the elements indicated, without leaving the scope of the adopted solution and thus remaining within the limits of the protection granted to the present patent.

The invention claimed is:

1. A dragging element for dragging web materials, the dragging element comprising:

a dragging element structure, at least a portion of said dragging element structure comprising an outer surface, said outer surface comprising a first outer surface portion and a second outer surface portion, said first outer surface portion being located adjacent to said second outer surface portion in a non-rotated state of said dragging element structure, said first outer surface portion and said second outer surface portion defining at least one through cut in said non-rotated state of said dragging element structure for engaging a part of a web material to be moved in a direction imposed by the dragging element structure that follows a predetermined operating path, said at least one through cut being helicoidal, said first outer surface portion being located at a spaced location from said second outer surface portion to define a peripheral opening in said outer surface in a rotated state of said dragging element structure, wherein two parts of said dragging element are rotated in opposite directions in said rotated state of said dragging element structure, said peripheral opening for receiving a web material such that a part of said web material is locked inside said at least one cut when said two parts of said dragging element are released.

2. A dragging element according to claim 1, wherein a cross section of the dragging element structure is solid.

3. A dragging element according to claim 1, wherein a cross section of said dragging element structure is biconvex.

4. A dragging element according to claim 1, wherein a cross section of said dragging element structure is star shaped.

5. A dragging element according to claim 1, wherein a cross section of said dragging element structure is circular.

6. A dragging element according to claim 1, wherein said dragging element structure is made of thermoplastic polyurethane.

7. A dragging element according to claim 1, wherein said dragging element structure comprises a plurality of twisted strands, said first outer surface portion being located opposite said second outer surface portion, said dragging element structure comprising a first inner surface portion and a second inner surface portion, said first inner surface portion and said second inner surface portion defining an inner space in said dragging element structure in said rotated state of said dragging element structure, said inner space being in fluid communication with said peripheral opening in said rotated state of said dragging element structure.

8. A dragging element according to claim 1, wherein said dragging element structure serves a plurality of machines which constitute a plant for paper converting, said dragging element structure extending from at least one of said plurality of machines to at least another one of said plurality of machines, said dragging element structure engaging at least one guide pulley.

9. A dragging element according to claim 1, wherein a cross section of the dragging element structure is not hollow.

10. A dragging element according to claim 1, wherein said at least one through cut extends through a cross section of said dragging element structure, said dragging element structure comprising a first inner surface portion and a second inner surface portion, said first inner surface portion and said second inner surface portion defining at least a portion of said at least one through cut and at least a portion of said cross section of said dragging element structure.

11. A dragging element according to claim 10, wherein said at least one through cut extends from one side of said dragging element structure to another side of said dragging element structure.

12. A dragging element according to claim 10, wherein said at least one through cut defines a first opening with a first dimension when said dragging element structure is in said non-rotated state, said peripheral opening defining a second dimension when said dragging element structure is in said rotated state, said second dimension being greater than said first dimension, wherein one end of said dragging element structure is rotated in one rotational direction and another end of said dragging element structure is rotated in another rotational direction in said rotated state, said one rotational direction being opposite said another rotational direction.

13. A dragging element for dragging web materials, the dragging element comprising:

a dragging element structure comprising an outer surface, said outer surface comprising a first outer surface portion and a second outer surface portion, said first outer surface portion and said second outer surface portion defining at least one through cut in said outer surface, each of said first outer surface portion and said second outer surface portion comprising a web material engaging surface for engaging a part of a web material to move the web material in a direction of the dragging element structure, said at least one cut comprising a helicoidal shape, said at least one through cut comprising a first dimension when said first outer surface portion and said second outer surface portion are in a non-rotated position, said first outer surface portion and said second outer surface portion defining a peripheral opening in said outer surface when said first outer surface portion and said second outer surface portion are in a rotated position, said peripheral opening comprising a second dimension, said first dimension being less than said second dimension, said at least one through cut receiving said part of said web material when said first outer surface portion and said second outer surface portion are in said rotated position.

14. A dragging element according to claim 13, wherein a cross sectional area of said dragging element defines at least a portion of said at least one through cut.

15. A dragging element according to claim 14, wherein said at least one through cut extends from one side of said dragging element structure to another side of said dragging element structure.

16. A dragging element according to claim 13, wherein said first outer surface portion comprises a first outer surface portion peripheral edge, said second outer surface portion comprising a second outer surface portion peripheral edge, said first outer surface portion peripheral edge and said second outer surface portion peripheral edge defining said at least one through cut with said first dimension when said dragging element structure is in a non-rotated state, said first outer surface portion peripheral edge and said second outer surface portion peripheral edge defining said opening with said second dimension when said dragging element structure is in a rotated state, wherein one end of said dragging element structure is rotated in one rotational direction and another end of said dragging element structure is rotated in another rotational direction in said rotated state, wherein said one rotational direction is opposite said another rotational direction, said dragging element structure comprising a first inner surface portion and a second inner surface portion, said first inner surface portion and said second inner surface portion defining an inner space of said dragging element structure in said rotated state of said dragging element structure, wherein said peripheral opening is in fluid communication with said inner space of said dragging element structure said rotated state.

17. A dragging element according to claim 13, wherein a cross section of said dragging element structure is star shaped.

18. A dragging element for dragging web materials, the dragging element comprising:

a dragging element structure comprising a dragging element structure interior and an outer surface comprising an outer surface peripheral area, said outer surface peripheral area comprising at least one opening in said outer surface, said outer surface comprising a first circumferential edge portion and a second circumferential edge portion in said outer surface peripheral area, said first circumferential edge portion and said second circumferential edge portion defining said at least one opening, said first circumferential edge portion being located opposite said second circumferential edge portion, said at least one opening being in fluid communication with said interior, said dragging element cross sectional area comprising a web material engaging surface for engaging a part of a web material to move the web material in a direction of the dragging element structure, said at least one opening comprising a helicoidal shape, said first circumferential edge portion and said second circumferential edge portion defining said web material engaging surface.

19. A dragging element according to claim 18, wherein said at least one opening extends from one side of said dragging element structure to another side of said dragging element structure, said outer surface comprising a third circumferential edge portion and a fourth circumferential edge portion, said third circumferential edge portion and said fourth circumferential edge portion defining at least a portion of said at least one opening in said outer surface on said another side of said dragging element structure.

20. A dragging element according to claim 18, wherein said at least one opening comprises a first dimension when said dragging element structure is in a non-rotated state, said at least one opening comprising a second dimension when said dragging element structure is in a rotated state, said second dimension being greater than said first dimension, wherein one end of said dragging element structure is rotated in one rotational direction and another end of said dragging element structure is rotated in another rotational direction in said rotated state, said one rotational direction being opposite said another rotational direction.

* * * * *